US007955189B2

(12) United States Patent
Vokey et al.

(10) Patent No.: US 7,955,189 B2
(45) **Date of Patent: *Jun. 7, 2011**

(54) SPIN MILLED GROOVES FOR A GOLF CLUB

(75) Inventors: Robert W Vokey, Carlsbad, CA (US); Peter J Gilbert, Carlsbad, CA (US); M Scott Burnett, Carlsbad, CA (US); Christopher R Kays, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/697,804

(22) Filed: Feb. 1, 2010

(65) Prior Publication Data

US 2010/0190572 A1 Jul. 29, 2010

Related U.S. Application Data

(62) Division of application No. 11/889,835, filed on Aug. 16, 2007, now Pat. No. 7,653,980, which is a division of application No. 10/902,064, filed on Jul. 30, 2004, now Pat. No. 7,273,422.

(60) Provisional application No. 60/528,708, filed on Dec. 12, 2003.

(51) Int. Cl.
*A63B 53/04* (2006.01)

(52) U.S. Cl. ..... 473/330; 473/331

(58) Field of Classification Search ..... 473/324–350, 473/287–292; D21/750

See application file for complete search history.

(56) References Cited

U.S. PATENT DOCUMENTS

| | | | | | |
|---|---|---|---|---|---|
| 732,136 | A | * | 6/1903 | Taylor | 473/331 |
| 1,536,616 | A | * | 5/1925 | Manning | 473/331 |
| 1,611,110 | A | * | 12/1926 | Thomas | 473/342 |
| 2,447,967 | A | * | 8/1948 | Ridgely | 473/332 |
| 4,413,825 | A | | 11/1983 | Sasse | 273/175 |
| 4,508,349 | A | | 4/1985 | Gebauer et al. | 473/330 |
| 4,529,203 | A | | 7/1985 | Ribaudo | 473/331 |
| 4,768,787 | A | | 9/1988 | Shira | 473/331 |
| 4,792,140 | A | | 12/1988 | Yamaguchi et al. | 473/331 |
| 4,801,146 | A | | 1/1989 | Honma | 473/342 |
| 4,858,929 | A | | 8/1989 | Long | 473/290 |
| 4,869,508 | A | | 9/1989 | Miller | 473/328 |
| 4,902,016 | A | | 2/1990 | Boone | 473/330 |
| 4,992,236 | A | | 2/1991 | Shira | 419/28 |

(Continued)

FOREIGN PATENT DOCUMENTS

JP 8191908 * 7/1996

(Continued)

OTHER PUBLICATIONS

Non-Final Office Action dated Dec. 30, 2008 of corresponding U.S. Appl. No. 11/889,835.*

(Continued)

*Primary Examiner* — Sebastiano Passaniti
(74) *Attorney, Agent, or Firm* — Murphy & King, P.C.

(57) ABSTRACT

The present invention is directed to a method of forming a golf club head with an improved striking surface. The grooves are machined into the strike surface with tight tolerances. The grooves have sharp edges, radiused ends, and a draft angle between about 2° and 12°. The striking face is machined such that it has a uniform texture with a roughness of more than 40 Ra.

20 Claims, 4 Drawing Sheets

U.S. PATENT DOCUMENTS

| | | | | |
|---|---|---|---|---|
| 5,100,144 | A | 3/1992 | Okumoto et al. | 473/331 |
| 5,358,249 | A | 10/1994 | Mendralla | 473/331 |
| 5,437,088 | A | 8/1995 | Igarashi | 29/527.6 |
| 5,447,311 | A | 9/1995 | Viollaz et al. | 473/342 |
| 5,458,334 | A | 10/1995 | Sheldon et al. | 473/349 |
| 5,591,092 | A | 1/1997 | Gilbert | 473/330 |
| 5,620,382 | A | 4/1997 | Cho et al. | 473/331 |
| 5,688,186 | A | 11/1997 | Michaels et al. | 473/290 |
| 5,774,970 | A | 7/1998 | Huang | 29/447 |
| 5,807,190 | A | 9/1998 | Krumme et al. | 473/342 |
| 5,879,243 | A | 3/1999 | Hackman | 473/342 |
| D410,053 | S * | 5/1999 | Wu | D21/733 |
| 5,967,903 | A | 10/1999 | Cheng | 473/342 |
| 6,074,309 | A | 6/2000 | Mahaffey | 473/342 |
| 6,099,414 | A | 8/2000 | Kusano et al. | 473/342 |
| 6,224,497 | B1 | 5/2001 | Antonious | 473/330 |
| 6,309,310 | B1 | 10/2001 | Shira | 473/331 |
| 6,319,437 | B1 | 11/2001 | Elsner et al. | 264/44 |
| 6,398,665 | B1 | 6/2002 | Antonious | 473/330 |
| 6,431,997 | B1 | 8/2002 | Rohrer | 473/324 |
| 6,638,180 | B2 | 10/2003 | Tsurumaki | 473/329 |
| 6,733,400 | B2 | 5/2004 | Sherwood | 473/290 |
| 6,739,984 | B1 | 5/2004 | Ciasullo | 473/345 |
| 6,814,673 | B2 | 11/2004 | Wahl et al. | 473/331 |
| 6,890,270 | B2 | 5/2005 | Ciasullo | 473/345 |
| 7,014,568 | B2 | 3/2006 | Pelz | 473/287 |
| 7,056,226 | B2 | 6/2006 | Kennedy | 473/330 |
| 7,273,422 | B2 | 9/2007 | Vokey et al. | 473/330 |
| 7,473,187 | B2 | 1/2009 | Vokey et al. | 473/330 |
| 7,568,983 | B2 * | 8/2009 | Gilbert | 473/330 |
| 7,594,862 | B2 | 9/2009 | Gilbert | 473/330 |
| 7,653,980 | B2 * | 2/2010 | Vokey et al. | 29/557 |
| 7,658,685 | B2 * | 2/2010 | Vokey et al. | 473/330 |
| 2002/0187851 | A1 * | 12/2002 | Chang | |
| 2003/0220157 | A1 * | 11/2003 | Dennis et al. | |
| 2004/0053704 | A1 * | 3/2004 | Gilbert | |
| 2004/0087387 | A1 * | 5/2004 | Wahl et al. | |
| 2004/0214654 | A1 * | 10/2004 | Pelz | |
| 2005/0037859 | A1 * | 2/2005 | Gilbert et al. | |
| 2005/0209020 | A1 * | 9/2005 | Burrows | |
| 2006/0154739 | A1 * | 7/2006 | Mann, Jr. et al. | |

FOREIGN PATENT DOCUMENTS

| | | | |
|---|---|---|---|
| JP | 10-248974 | * | 9/1998 |
| JP | 2002-224250 | * | 8/2002 |
| JP | 2004-141277 | * | 5/2004 |

OTHER PUBLICATIONS

Final Office Action dated Jun. 30, 2009 of corresponding U.S. Appl. No. 11/889,835.*

Non-Final Office Action dated Aug. 25, 2006 of corresponding U.S. Appl. No. 10/902,064.*

Final Office Action dated Feb. 20, 2007 of corresponding U.S. Appl. No. 10/902,064.*

Notice of Allowance dated May 23, 2007 of corresponding U.S. Appl. No. 10/902,064.*

Non-Final Office Action dated Nov. 18, 2009 of corresponding U.S. Appl. No. 12/007,223.*

Final Office Action dated Apr. 23, 2010 of corresponding U.S. Appl. No. 12/007,223.*

Non-Final Office Action dated Oct. 17, 2008 of corresponding U.S. Appl. No. 11/711,096.*

Non-Final Office Action dated Mar. 5, 2008 of corresponding U.S. Appl. No. 11/889,836.*

Notice of Allowance dated Oct. 20, 2008 of corresponding U.S. Appl. No. 11/889,836.*

Non-Final Office Action dated Mar. 18, 2009 of corresponding U.S. Appl. No. 12/327,371.*

Notice of Allowance dated Sep. 30, 2009 of corresponding U.S. Appl. No. 12/327,371.*

Non-Final Office Action dated Feb. 4, 2009 of corresponding U.S. Appl. No. 11/475,920.

Non-Final Office Action dated Oct. 23, 2009 of corresponding U.S. Appl. No. 11/475,920.

Final Office Action dated Apr. 26, 2010 of corresponding U.S. Appl. No. 11/475,920.

Advisory Action dated Jul. 13, 2010 of corresponding U.S. Appl. No. 11/475,920.

Japanese Office Action dated Jun. 9, 2010 of corresponding Japanese Patent Application No. 2008-045633.

Notice of Allowance dated Sep. 3, 2010 of corresponding U.S. Appl. No. 12/007,223.

* cited by examiner

SPIN MILLED GROOVES FOR A GOLF CLUB

CROSS-REFERENCE TO RELATED APPLICATIONS

This application is a divisional of U.S. patent application Ser. No. 11/889,835, filed Aug. 16, 2007, now U.S. Pat. No. 7,653,980, which is a divisional of U.S. patent application Ser. No. 10/902,064, filed Jul. 30, 2004, now U.S. Pat. No. 7,273,422, which claims the benefit of U.S. Provisional Patent Application No. 60/528,708, filed Dec. 12, 2003. Each of these applications is incorporated herein by reference in their entireties.

BACKGROUND OF THE INVENTION

1. Field of the Invention

The present invention relates to golf clubs. In particular, the present invention relates to a golf club head having an improved striking surface.

2. Description of the Related Art

Golf club heads come in many different forms and makes, such as wood- or metal-type, iron-type (including wedge-type club heads), utility- or specialty-type, and putter-type. Each of these styles has a prescribed function and make-up.

Iron-type and utility-type golf club heads generally include a front or striking face, a top line, and a sole. The front face interfaces with and strikes the golf ball. A plurality of grooves, sometimes referred to as "score lines," is provided on the face to assist in imparting spin to the ball. The top line is generally configured to have a particular look to the golfer and to provide structural rigidity for the striking face. A portion of the face may have an area with a different type of surface treatment that extends fractionally beyond the score line extents. Some club heads have the surface treatment wrap onto the top line. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The United States Golf Association (USGA) publishes and maintains the Rules of Golf, which govern golf in the United States. Appendix II to the USGA Rules provides several limitations for golf clubs. For example, the width of a groove cannot exceed 0.035 inch, the depth of a groove cannot exceed 0.020 inch, and the surface roughness within the area where impact is intended must not exceed that of decorative sand-blasting or of fine milling. The Royal and Ancient Golf Club of St Andrews, which is the governing authority for the rules of golf outside the United States, provides similar limitations to golf club design.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
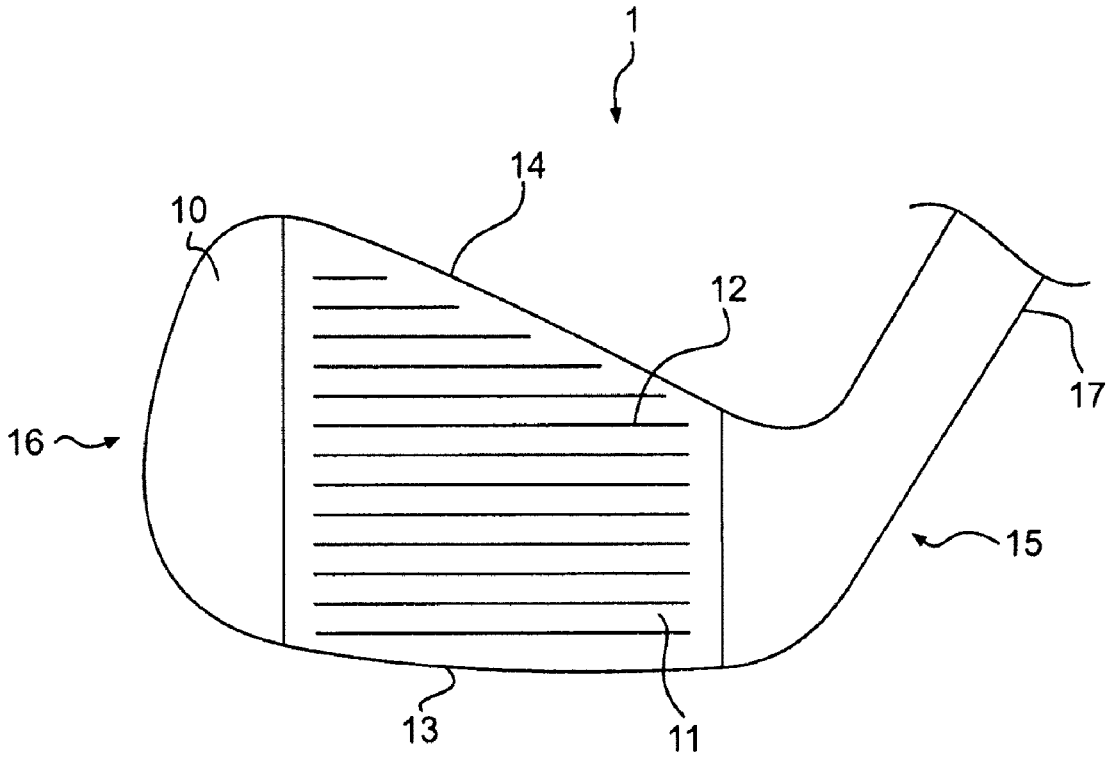
FIG. 1 shows a golf club head of the present invention.

The present invention is directed to a golf club head with an improved striking surface. FIG. 1 shows a golf club head 1 of the present invention. The golf club head 1 includes a body 10 defining a front surface 11, a sole 13, a top line 14, a heel 15, a toe 16, and a hosel 17. The striking face of the front surface 11, which contains grooves 12 therein, and the sole 13 may be unitary with the body 10, or they may be separate bodies, such as inserts, coupled thereto. While the club head 1 is illustrated as an iron-type golf club head, the present invention may also pertain to a utility-type golf club head or a wood-type club head.

Figure 2:
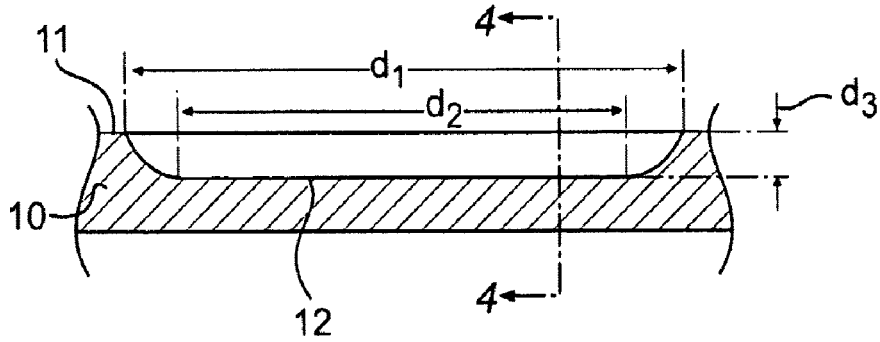
FIG. 2 shows a cross-sectional view of a club head of the present invention along a groove.

FIG. 2 shows a cross-sectional view of the club head 1 along a groove 12. Grooves 12 are machined into the surface of the striking face 11, which allows the draft angle to be decreased. Grooves 12 extend from a toe end of the club head 1 to a heel end of the club head 1. The grooves 12 are shallow at both the toe and heel portions of the club head 1, and are deep in the central regions. Grooves 12 have a first distance d1 measured along the surface of striking face 11 and a second distance d2 measured along the deepest portion of the grooves, which have a depth d3. Thus, first distance d1 is an overall distance and second distance d2 is a maximum depth distance. Preferably, the groove depth along the maximum depth distance d2 is substantially constant. In one embodiment the maximum depth distance d2 is at least 0.25 inch shorter than the overall distance d1. The groove draft angle a ranges from about 0.5° to 12°, more preferably about from 4° to 6°, and most preferably 5°.

Figure 3:
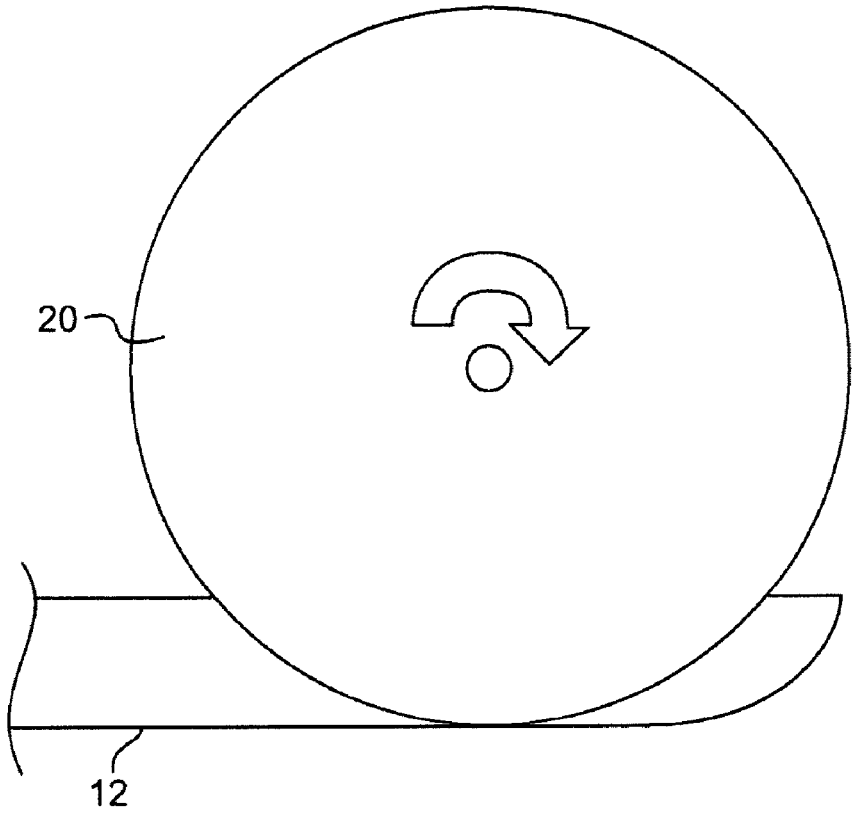
FIG. 3 shows a preferred groove cutting setup.

Grooves 12 are radiused at the toe and heel portions of the club head 1, and are about 0.02 inch deep at a geometric center of the face 11. Grooves 12 are machined into the strike face surface 11. The club head 1 is retained in a mold, which preferably is formed of a material soft enough to not damage the club head 1 yet resilient enough to firmly retain the golf club head 1, and a cutter, preferably a round cutter or a saw cutter, is used to form the grooves 12. Preferred cutters have a diameter from ⅜ inch to ¾ inch. A preferred range of groove radii include from 0.125 inch to 5 inches, with 0.25 inch to 2.5 inches being more preferred. Having radiused grooves 12 facilitates removal of dirt, grass, sand, and other materials that typically become embedded within the grooves of a golf club during normal use by eliminating corners that can trap these materials. FIG. 3 shows a preferred groove cutting setup illustrating cutter 20 with groove 12.

Figure 4:
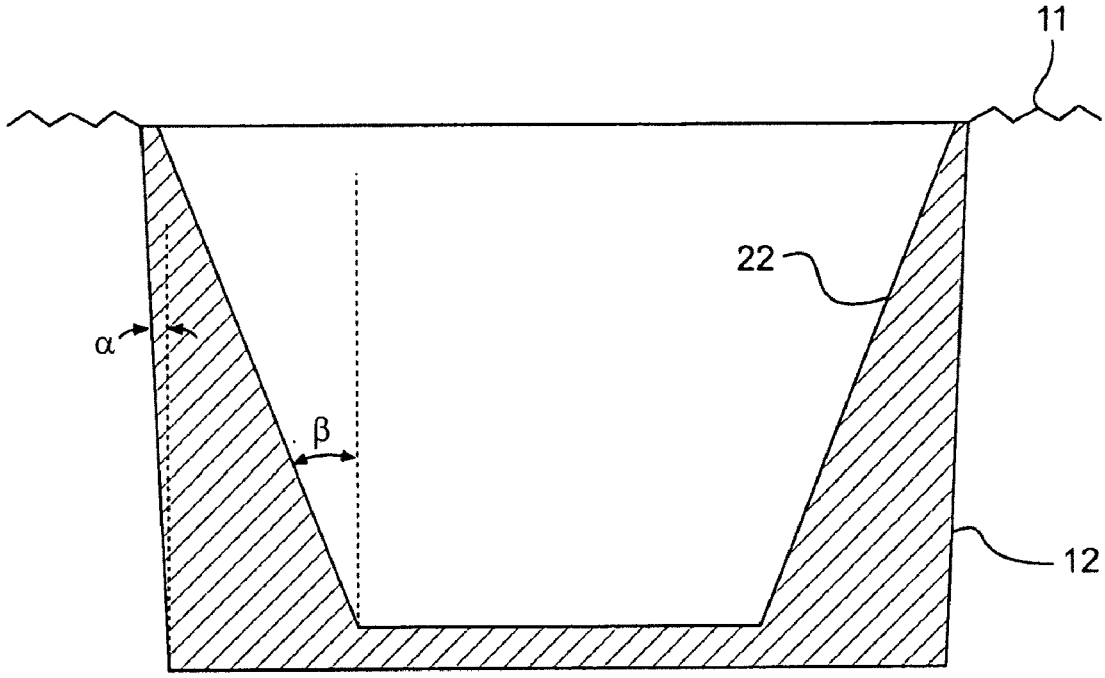
FIG. 4 shows a comparison of a groove of the golf club head of FIG. 1 as viewed along lines 4-4 of FIG. 2 with a known groove.

Machining the grooves 12, in addition to decreasing the draft angle, increases the rate of production and allows for tighter tolerances than casting or forging. The rate of production is increased by decreasing the number of required manufacturing steps. Instead of inserting the tool into the club face, machining the grooves, and removing the tool from the club face in three separate steps, as required by known groove creating processes, the present invention allows all three to be combined into one step. This is possible because the turning axis of the present cutter is parallel to the face, rather than the perpendicular axes of known processes. The tighter tolerances possible with the present invention allow less material to be removed, also decreasing manufacturing time. FIG. 4 shows a comparison of a groove 12 of the present invention with a typical groove 22 of known golf club heads. The groove 12 preferably has a depth of 0.02 inch, which is the USGA limit. Due to loose tolerances, known grooves 22 were designed well short of this limit. Similarly, known manufacturing processes required a large draft angle β, typically around 16°. The draft angle a of grooves 12 is much smaller, increasing the groove volume.

As noted above, the governing bodies of golf place limitations of the geometry of grooves 12. The increased tolerance control afforded by machining the grooves 12 of the present invention allows the actual groove geometry to be closer to the limits than was previously achievable. Thus, the grooves 12 of the present invention maximize groove volume, enhancing the groove performance during use. With the improved grooves of the present invention, the grooves better grip the ball, allowing a golfer to apply more spin to the ball. The golfer's control over the ball, both during ball flight and subsequent to flight, such as when landing and settling on a golf green, are increased. The grooves 12 of the present invention also result in a golf club head that is more aesthetically pleasing and that allows better ball control.

Figure 5:
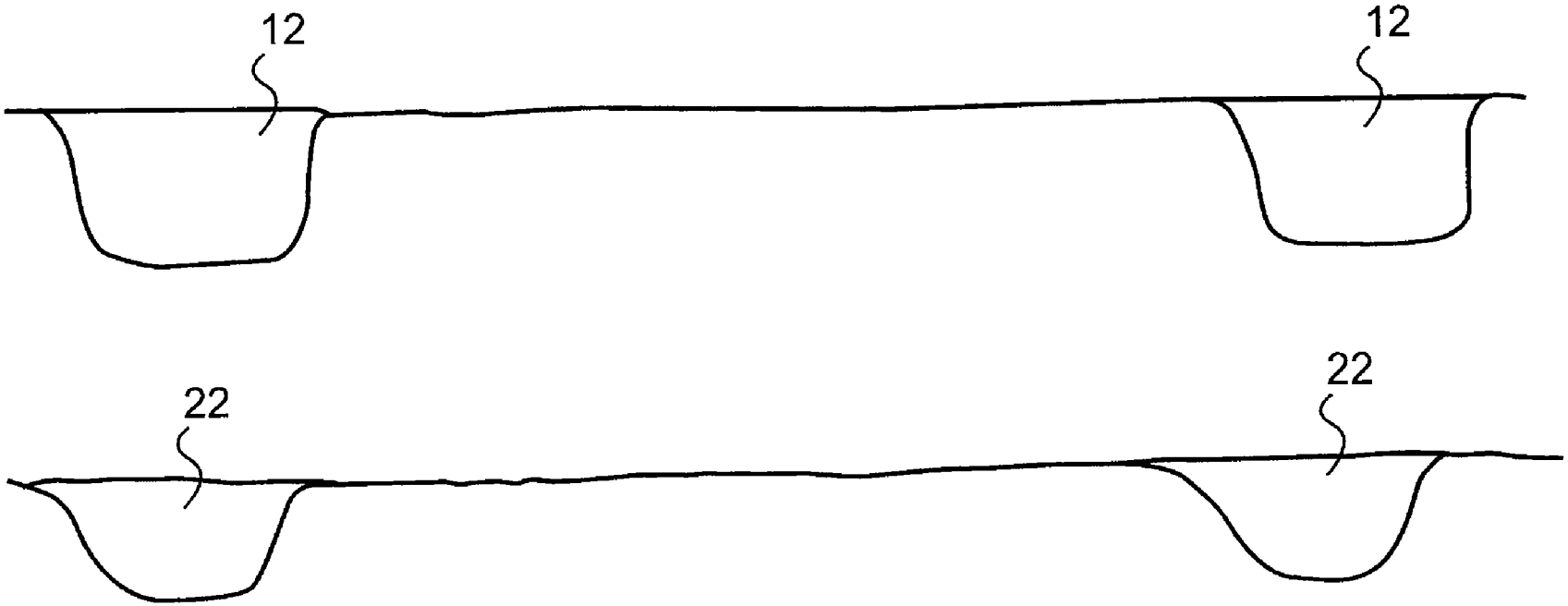
FIG. 5 shows a comparison of a groove of the golf club of FIG. 1 and a known groove.

FIG. 5 shows a comparison of a groove 12 of the present invention with a typical groove 22 of known golf club heads. The known grooves 22 are quite rounded. The grooves 12 of the present invention, however, are much sharper. The edges are more defined, the depth is greater, and the dimensions are more consistent and closer to the limits. All of these factors allow the golf club head 1 to better grip the golf ball, increasing the user's control over the ball.

The face 11 of the club head 1 of the present invention is also enhanced to provide additional ball control and enhanced performance. The strike surface 11 is provided with a roughened texture. A common measure of roughness in surface finish is average roughness, Ra. Ra, also known as Arithmetic Average (AA) and Center Line Average (CLA), is a measure of the distance from the peaks and valleys to the center line or mean. It is calculated as the integral of the absolute value of the roughness profile height over the evaluation length:

$$Ra = \frac{1}{L}\int_0^L |r(x)|\,dx$$

The face 11 is roughened by machining, preferably with a Computer Numerically Controlled (CNC) mill. Known golf clubs have a face roughness at most 40 Ra. At least a portion of the face 11 in the proximity of the grooves, and more preferably the entire face 11, is machined such that it has a substantially uniform textured surface with a roughness greater than 40 Ra. Preferably, the roughness is from 75 Ra to 300 Ra, more preferably from 100 Ra to 200 Ra, and most preferably from 120 Ra to 180 Ra.

Providing a textured strike face allows the golfer to apply more friction to the ball during use, allowing the golfer to put more spin on the ball and have greater control of the ball. Conventionally, golfers have to take a full swing to induce enough golf ball spin to control the ball movement on a golf green. With the golf club head of the present invention, a golfer can induce golf ball spin in "partial" shots, or shots when the golfer is not taking a full swing. The textured strike surface of the present invention also distributes the shear force resulting from the golf swing over a greater area of the golf ball. This reduces cover damage and extends golf ball life.

The golf club head 1 preferably is formed of a soft base metal, such as a soft carbon steel, 8620 carbon steel being an example. A chrome finish may be applied to the base metal to inhibit wear and corrosion of the base metal. If included, the chrome finish preferably includes a non-glare layer. The chrome finish layer preferably has a thickness between 12 μin and 0.005 μin, with 80 μin a preferred thickness. A nickel finish may alternatively be applied to the base metal. If included, the nickel finish preferably has a thickness between 500 μin and 1000 μin, with 800 μin a preferred thickness.

In use, the grooves 12 and strike face 11 of the present invention enhance performance, especially in adverse conditions. The higher friction possible with the golf club head 1 allows a tighter grip on the golf ball during "wet" or "grassy" conditions than was previously possible. The club head of the present invention was tested, and as shown in Table 1 below, the generated revolutions per minute of a struck golf ball were substantially the same as those generated with a convention club for a full dry shot, but were increased in a half dry shot and in both a full wet shot and a half wet shot. The "dry" shots contained substantially no moisture on the club face and ball. For the "wet" shots, the club face and/or the golf ball surface were sprayed with water in an amount that would be typical for shots made during a round in dewy or rainy conditions. A 60° wedge was used in these tests. Table 1 shows the revolutions per minute of a golf ball after being struck with a standard club or a spin milled club of the present invention, and illustrates the benefit of the spin milled grooves over standard grooves.

TABLE 1

| Shot Conditions | Standard | Spin Milled |
|---|---|---|
| Dry - full | 12250 | 12000 |
| Dry - half | 6500 | 7750 |
| Wet - full | 8000 | 12000 |
| Wet - half | 4000 | 8000 |

A preferred method of making the club head 1 includes first making a club head body. This may be done by casting, forging, or any other manufacturing method. The face is then machined such that it is substantially smooth and flat, preferably flat within ±0.002 inch. This preferably may be done by fly-cutting the face, which is cutting with a single-point tool fixed to the end of an arm protruding from a vertical milling shaft. Having a flat face allows the golfer to achieve consistent results during use. The body preferably is nested during the face flattening process. That is, the body is retained within a housing such that it is substantially immobile. The face is left exposed so that it can be worked on. The housing may be padded or otherwise designed such that it does not damage the club head.

Once the requisite face flatness has been achieved, the grooves are created and the surface is roughened as described above. While it is preferred that the grooves be spin milled prior to roughening the surface, the order of these steps is not essential. In fact, it is possible that they be performed substantially simultaneously, or with at least some amount of overlap.

The spin milled grooves may have very sharp edges, which could have an adverse effect on a golf ball during use. Thus, the grooves may be deburred to remove any sharp edges in the groove-to-face junction. This creates a radius at the junction, the radius preferably being less than 0.01 inch. This deburring can be carried out in a variety of ways. The junction may be filed, such as with a wire brush or a file, such as a carbide file. In conjunction with filing, or as an alternative method, the junction can be deburred by blasting. This may include impacting small beads at the junction at high speeds. To protect the face of the club head, which may have already been roughened above 40 Ra, the face may be masked. Masking includes placing a physical barrier on the face adjacent the grooves such that the projected particles cannot impact the face. Alternatively or in conjunction with masking, a nozzle can be used to accurately direct the projected material only at the junction.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club comprising a face with a striking surface comprising grooves formed therein, wherein the grooves have longitudinal axes and the grooves are radiused at toe and heel portions of the golf club head about axes of rotation that are perpendicular to the longitudinal axes, and wherein the striking surface comprises an area in the proximity of the grooves with a substantially uniform textured surface having a roughness from about 75 Ra to about 300 Ra in an area in the proximity of said grooves.

2. The golf club of claim 1, wherein the grooves have a draft angle from about 0.5° to 12°.

3. The golf club of claim 2, wherein the grooves have a draft angle from 4° to 6°.

4. The golf club of claim 1, wherein the grooves are about 0.02 inch deep at a geometric center of the face.

5. The golf club of claim 1, wherein the substantially uniform textured surface has a roughness from about 100 Ra to 200 Ra.

6. The golf club of claim 5, wherein the substantially uniform textured surface has a roughness from about 120 Ra to 180 Ra.

7. The golf club of claim 1, wherein the entire striking surface has a substantially uniform textured surface having a roughness from about 75 Ra to about 300 Ra.

8. A golf club comprising a body with a striking surface comprising grooves formed therein, wherein the grooves have a draft angle from about 0.5° to about 12° , wherein the striking surface has a substantially uniform textured surface with a roughness greater than 40 Ra, and wherein at least one of the grooves has a longitudinal axis and is radiused at toe and heel portions of the golf club head about an axis of rotation that is perpendicular to the longitudinal axes.

9. The golf club head of claim 8, wherein the grooves contain longitudinal axes and the grooves are radiused at toe and heel portions of the golf club head about axes of rotation that are perpendicular to the longitudinal axes.

10. The golf club head of claim 8, wherein the substantially uniform textured surface has a roughness from about 75 Ra to 300 Ra.

11. The golf club of claim 10, wherein the substantially uniform textured surface has a roughness from about 100 Ra to 200 Ra.

12. The golf club of claim 11, wherein the substantially uniform textured surface has a roughness from about 120 Ra to 180 Ra.

13. A golf club comprising a body comprising a front surface, a sole, a top line, a heel, and a toe, wherein the front surface comprises a striking face comprising grooves extending from the heel to toe formed therein, wherein the grooves have longitudinal axes and are radiused at the toe and the heel about an axis of rotation that is perpendicular to the longitudinal axes, wherein the grooves are shallower at the toe and heel than in a central portion, wherein the striking face comprises an area in the proximity of the grooves with a substantially uniform textured surface with a roughness greater than 40 Ra.

14. The golf club of claim 12, wherein the entire striking surface has a substantially uniform textured surface having a roughness from about 75 Ra to about 300 Ra.

15. The golf club of claim 12, wherein the grooves have a draft angle from about 0.5° to 12°.

16. The golf club of claim 14, wherein the grooves have a draft angle from 4° to 6°.

17. The golf club of claim 12, wherein the grooves have a depth of about 0.02 inch at a geometric center of the striking face.

18. The golf club head of claim 12, wherein the substantially uniform textured surface has a roughness from about 75 Ra to 300 Ra.

19. The golf club of claim 18, wherein the substantially uniform textured surface has a roughness from about 100 Ra to 200 Ra.

20. The golf club of claim 19, wherein the substantially uniform textured surface has a roughness from about 120 Ra to 180 Ra.

* * * * *